United States Patent [19]

Oike et al.

[11] Patent Number: 4,892,602

[45] Date of Patent: Jan. 9, 1990

[54] HEAT-SENSITIVE TRANSFER MEDIUM

[75] Inventors: Hitoshi Oike; Motoshige Yanagimachi, both of Kyoto, Japan

[73] Assignee: Oike Industrial Co., Ltd., Kyoto, Japan

[21] Appl. No.: 85,190

[22] Filed: Aug. 14, 1987

[30] Foreign Application Priority Data

| | | | |
|---|---|---|---|
| Aug. 19, 1986 | [JP] | Japan | 61-195013 |
| Sep. 4, 1986 | [JP] | Japan | 61-208722 |
| Feb. 16, 1987 | [JP] | Japan | 62-32984 |

[51] Int. Cl.[4] ..... B41M 5/26

[52] U.S. Cl. ..... 156/233; 156/234; 156/239; 156/240; 156/277; 400/120; 428/195; 428/209; 428/216; 428/336; 428/339; 428/334; 428/346; 428/354; 428/913; 428/914

[58] Field of Search ..... 428/195, 204, 207, 209, 428/209; 428/216; 428/336; 428/339; 428/344; 354, 339, 344, 346; 156/233, 234, 277, 239, 240; 400/120, 241, 241.1, 241.4

[56] References Cited

U.S. PATENT DOCUMENTS

| | | | |
|---|---|---|---|
| 3,235,395 | 2/1966 | Scharf | 428/484 |
| 4,101,698 | 7/1978 | Dunning et al. | 428/209 |
| 4,250,209 | 2/1981 | de Leeuw et al. | 428/209 |
| 4,495,232 | 1/1985 | Bauser et al. | 428/41 |
| 4,559,273 | 12/1985 | Kutsukake et al. | 428/484 |

FOREIGN PATENT DOCUMENTS

| | | | |
|---|---|---|---|
| 169705 | 1/1986 | European Pat. Off. | 428/488.4 |
| 60-151096 | 8/1985 | Japan | 428/488.4 |

*Primary Examiner*—Pamela R. Schwartz

*Attorney, Agent, or Firm*—Oblon, Spivak, McClelland, Maier & Neustadt

[57] ABSTRACT

A heat-sensitive transfer medium comprising a support, and a transfer layer comprising a protective resin layer, a metal deposition layer and an adhesive layer, said three layers being provided in that order from the supporting side. The transfer layer of the medium can be selectively transferred to a plain paper upon heating with a thermal head to give a transfer image having an excellent metallic luster.

13 Claims, 1 Drawing Sheet

HEAT-SENSITIVE TRANSFER MEDIUM

BACKGROUND OF THE INVENTION

The present invention relates to a heat-sensitive transfer medium for use in thermal transfer apparatuses such as thermal printer and facsimile. More particularly, it relates to a heat-sensitive transfer medium capable of providing print images, such as letters, symbols and patterns, which have a metallic luster such as gold or silver.

A heat-sensitive transfer medium which has been widely used heretofore is that wherein a heat-meltable ink layer which is melted in a prescribed temperature is provided on a support, for instance, having a thickness of 3 to 12 μm.

The mechanism of printing using such heat-sensitive transfer medium is as follows: A thermal head is brought into contact with the back surface of the support of the transfer medium. When plural heating elements of the thermal head are selectively activated on the basis of signals for printing to generate heat, portions of the heat-meltable ink layer which are positioned on the heated portions of the support are melted and transferred to a receiving medium, such as plain paper, which is brought into contact with the heat-meltable ink layer, providing transfer images of the heat-meltable ink corresponding to the printing signals on the receiving medium. Thus, the use of the heat-sensitive transfer medium makes possible printing onto a plain paper.

The heat-meltable ink layer used in the conventional heat-sensitive transfer medium is usually an ink layer wherein pigments such as carbon black are mixed with a heat-meltable vehicle such as wax. For this reason, the color of the transfer image formed on the receiving medium is restricted to that of the pigment used in the heat-meltable ink layer. Although a heat-meltable ink layer wherein a metal powder is used as a pigment is known, it cannot absolutely provide a transfer image having an excellent metallic luster such as specular gloss.

On the other hand, a plastic film is usually used as a support for the above-mentioned heat-sensitive transfer medium. However, usual plastic films have a melting or softening temperature of 200° to 300° C. at the highest and also a heat deformation temperature of 100° C. at the highest, while the surface temperature of the thermal head goes up to high temperatures of 300° to 400° C. When such plastic film as the support is heated with the thermal head during printing, the so-called "hot-sticking phenomenon" occurs. The hot-sticking phenomenon involves disadvantages such as sticking of the thermal head to the plastic film (hereinafter referred simply to as "sticking"), which causes hindering in the feeding of the transfer medium; and attaching of some melts (hereinafter referred to as "sticking-dust") of the plastic film to the thermal head.

In order to prevent such hot-sticking phenomenon, heretofore, an attempt that a sticking-preventive layer was provided on the back surface of the plastic film which is to be brought into contact with the thermal head was made. As the sticking-preventive layer, there were proposed a metal layer, a heat-resistant resin layer, a layer composed of benztriazole, an ethyl cellulose layer containing sodium stearyl sulfate and a polyester resin layer containing stearic acid. However, these sticking-preventive layers had drawbacks that when the thickness was small, a sufficient sticking-preventive effect was not attained, and when the thickness was large, the heat-sensitivity was reduced due to an increase in heat capacity and the sticking-preventive layer itself rather causes sticking and sticking-dust.

It is an object of the present invention to provide a heat-sensitive transfer medium capable of producing transfer images with a variety of metallic lusters including a specular gloss and an appropriately matted metallic luster being remarkably artistic.

Another object of the present invention is to provide a heat-sensitive transfer medium improved in sticking-preventive property as well as the above-mentioned ability of producing transfer images with an excellent metallic luster.

These and other objects of the invetnion will become apparent from the description hereinafter.

SUMMARY OF THE INVENTION

The present invention provides a heat-sensitive transfer medium comprising a support, and a transfer layer comprising a protective resin layer, a metal deposition layer and an adhesive layer, said three layers being provided in that order from the support side.

When the protective resin layer is an unmatted one, the transfer medium can give a transfer image having a specular gloss or a luster close thereto. When the protective resin layer is a matted one, the transfer medium can give a transfer image having a matted metallic luster.

The present invention further provides a heat-sensitive transfer medium wherein a sticking-preventive layer comprising, as a main component, a fluorine-containing compound such as a fluorine-containing surface active agent or a fluorine-containing polymer is provided on the back surface of the support of the above-mentioned transfer medium. The transfer medium exhibits an excellent sticking-preventive effect due to improved heat-resistance and slipping property between the transfer medium and the thermal head.

DETAILED DESCRIPTION

A feature of the present invention is that a transfer layer comprising plural integrated layers, i.e. a protective resin layer, a metal deposition layer and an adhesive layer is used instead of the heat-meltable ink layer of the conventional heat-sensitive transfer medium.

When the transfer layer is transferred to a receiving medium by means of a thermal head, a transfer image having an excellent metallic luster can be obtained on a receiving medium.

Figure 1:
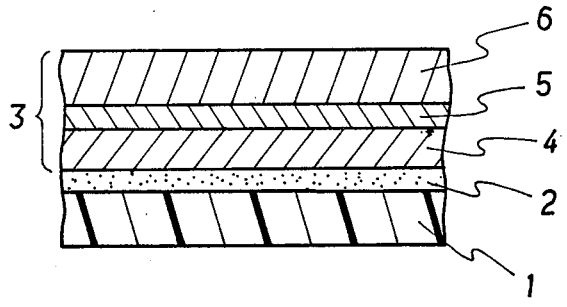
FIG. 1 is a schematic cross-section showing an embodiment of the heat-sensitive transfer medium of the present invention.

Referring to FIG. 1, a heat-sensitive transfer medium in accordance with the present invention comprises a support 1 and a transfer layer 3 comprising at least a protective resin layer 4, a metal deposition layer 5, which three layers are provided in that order from the support side. The protective resin layer 4 is provided either directly on the support 1 or on a lubricant layer 2 provided on the support 1.

When the protective resin layer 4 is an unmatted layer, a transfer image having a metallic luster close to specular gloss is obtained. When the protective resin layer 4 is a matted layer, a transfer image having a metallic luster which is matted suitably and remarkably artistic.

Any known support having a sufficient self-supportability can be used as the support 1 without any particular limitation. Examples of the support include films of resins such as polyester, polyamide, polyamidimide, polyethylene, polypropylene, cellulose acetate, polycarbonate, vinyl chloride resin and fluorine-containing resin; cellophane; papers such as glassine paper; and release papers or films.

The preferred support is a film of the foregoing resin and having a thickness of 2.5 to 9 μm, especially 2.5 to 6 μm, which ensures mass-production of a heat-sensitive transfer medium having no defects such as wrinkle or crack according to a continuous process. In the case of a conventional hot stamping foil, a support having a thickness of 12 μm is usually used. However, in the case of such a heat-sensitive transfer medium as intended in the present invention, a support having a good heat conduction is required, because a transfer layer must be transferred upon heating for a very short time, for example, 1 to 5 milliseconds, by means of a thermal head. For this reason, a support having a thickness within the above range is preferable.

If a release property between the support 1 and the protective resin layer 4 is poor, it is preferable to provide a lubricant layer 2 on the support 1. Examples of the lubricant used for forming the layer 2 include paraffin waxes, silicone resins, fluorine-containing polymers and surface active agents.

The metal deposition layer itself used in the present invention is poor in mechanical strength and susceptible to damages caused by abrasion. Therefore, the protective resin layer 4 is provided on the support 1 so that the layer 4 is positioned on the metal deposition layer 5 with respect to a transfer image formed. The thickness of the protective layer is not particularly limited. However, a thickness of 0.5 to 2 μm is preferable.

A variety of resins including thermoplastic resins, thermosetting resins, electron beam-curable resins and ultraviolet radiation-curable resins can be used as a resin for forming the protective layer 4. Typical examples of the resins are acrylic resins, vinyl chloride-vinyl acetate copolymer, polyvinyl butyral, polycarbonate, nitrocellulose, cellulose acetate, urethane resins, urea resins, melamine resins, urea melamine resins, epoxy resins, alkyd resins, amino alkyd resins and rosin-modified maleic resin. These resins may be used singly or as admixtures thereof.

When a matted metallic luster is desired, a matting agent is added to the above-mentioned resin. Examples of the matting agent include silica, talc, calcium carbonate, precipitated barium sulfate, alumina, acid clay, magnesium carbonate, carbon black, tin oxide and titanium white. These matting agents may be used singly or as admixtures thereof. The matting agent is usually contained in an amount of 1 to 20% by weight in the protective layer.

The protective layer 4 is formed by applying a solution of the above-mentioned resin in an organic solvent or water to the support 1 or the lubricant layer 2 by a usual coating method such as roller coating, gravure coating or reverse coating and drying the resulting coating (hardening or curing in the case of the thermosetting resin, electron beam-curable resin or ultraviolet radiation-curable resin).

The protective layer 4 may be colored by use of a coloring agent such as dye or pigment so long as the resulting layer is transparent or translucent.

The protective layer 4 also serves as a layer for supporting the metal deposition layer 5 in the course of transfer. If the protective layer 4 is melted or considerably deformed upon heating with a thermal head, the metal deposition layer 5 tends to cause whitening, which results in disappearance of the metallic luster. From this point of view, it is desirable that the protective layer has a heat deformation temperature of at least 90° C., especially at least 120° C., though it varies depending upon the kind of the adhesive layer.

The metal deposition layer 5 is formed on the protective layer 4 by depositing a metal or a metal alloy by a usual thin metal film forming method such as vacuum-deposition method, sputtering method or ion-plating method. Examples of the materials used for forming the metal deposition layer are metals such as zinc, aluminum, gallium, indium, tin, nickel, silver, gold, copper, silicon, chromiun, titanium, platinum and palladium; mixtures of two or more foregoing metals; and alloys of two or more foregoing metals. Aluminum is the most preferable, because of its good luster and cheapness.

The thickness of the metal deposition layer is preferably from 10 to 100 nm. A metal deposition layer having a thickness of less than 10 nm is undesirable, because it cannot have a sufficient metallic luster. The use of a metal deposition layer having a thickness of more than 100 nm is uneconomical, because it cannot give a better metallic luster than a metal deposition layer having a thickness of 100 nm. The metal deposition layer may be either a single layer or plural layers. In the case of the latter, different metals may be used for every layer. Further, a construction wherein an interference thin film composed of a transparent resin or a transparent inorganic metal compound is sandwiched between a first metal deposition layer having a thickness in the vicinity of 30 nm, which layer is to be positioned as an upper layer with respect to a transfer image, and a second metal deposition layer thicker than the first metal deposition layer, which second layer is to be positioned as an under layer with respect to the transfer image, may be adopted. Such construction gives interference colors like rainbow.

The adhesive layer 6 used in the present invention is composed of at least one of waxes, resins and elastomers as a main component. Examples of the waxes, resins and elastomers used include natural waxes such as whale wax, bees wax, lanolin, carnauba wax, candelilla wax and montan wax; synthetic waxes such as paraffin wax, microcyrstalline wax, oxidized wax, ester wax and low molecular weight polyethylene; higher fatty acids such as lauric acid, myristic acid palmitic acid, stearic acid and behenic acid; higher alcohols such as stearyl alcohol and behenyl alcohol; esters such as sucrose fatty acid esters and sorbitan fatty acid esters; amides such as stearoyl amide and oleic amide; resins such as spolyamide resins, polyester resins, epoxy resins, polyurethane resins, acrylic resins, vinyl chloride resins, cellulosic resins, vinyl acetate resins, petroleum resins, ethylene-vinyl acetate copolymer resins, phenolic resins and styrene resins; elastomers such as natural rubber, styrene-butadiene rubber, isoprene rubber, and chloroprene rubber. These substances may be used singly or as admixtures thereof.

One or more additives including tackifier such as rosin, rosin derivatives, terpene resin or hydrogenated petroleum resin; filler; plasticizer; and antioxidant may be added to the above-mentioned main component.

It is preferable that the adhesive layer 6 has a melting point lower than that of the adhesive layer used in a conventional hot stamping foil for use in stamping on paper, because the adhesive layer used in the present invention must be melted quickly upon heating for an extremely short time (e.g. 1 to 5 milliseconds) by means of a thermal head. Usually the melting point of the adhesive layer is from 70° to 100° C.

The thickness of the adhesive layer 6 varies depending upon the surface property of a receiving paper. However, the thickness is usually selected from the range of 1 to 10 μm. When a usual receiving paper having a smooth surface is used, an adhesive layer having a thickness of 1 to 2 μm is preferably used.

Any conventional sticking-preventive layer may be provided on the back surface of the support 1 which is to be brought into contact with a thermal head. In order to preventing sticking, it is also preferable to provide, on the back surface of the support 1, a thin layer having a thickness of 6 to 100 nm and made of an inorganic substance including oxides such as SiO, $SiO_2$, $TiO_2$, ZnO, $ZrO_2$ and $Al_2O_3$; nitrides such as TiN; carbides such as TiC; carbon; metals such as Al, Ni, Cr, Ti and Ni-Cr alloy, which is disclosed in Japanese Unexamined Patent Publication No. 62-119097.

Another future of the present invention is that a sticking-preventive layer containing, as a main component, a fluorine-containing compound such as fluorine-containing surface active agent or fluorine-containing polymer is used.

Figure 2:
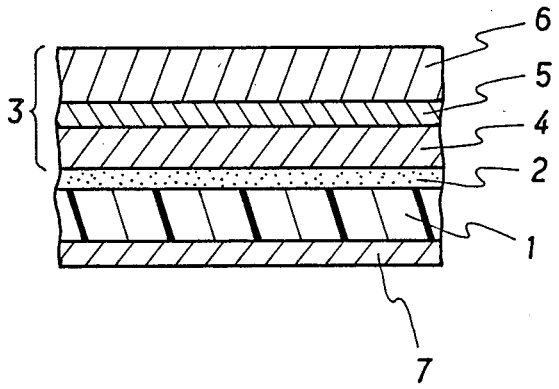
FIG. 2 is a schematic cross-section showing another embodiment of the heat-sensitive transfer medium of the present invention.

Referring to FIG. 2, a sticking-preventive layer 7 is provided on the back surface of the support 1, preferably resin film, which is to be brought into contact with a thermal head.

The sticking-preventive layer 7 is a layer which contains a fluorine-containing compound as a main component and preferably the compound is mixed with a heat-resistant resin.

Preferred examples of the fluorine-containing compound are fluorine-containing surface active agents and fluorine-containing polymers.

Examples of the fluorine-containing surface active agent are anionic fluorine-containing surface active agents including perfluoroalkylsulfonic acid salts such as compound having the formula: $R_f—SO_3M$, phosphoric esters containing perfluoroalkyl group such as compound having the formula:

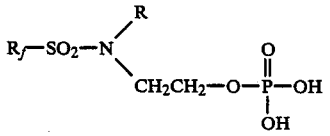

and perfluoroalkyl-containing carboxylic acid salts such as compound having the formula:

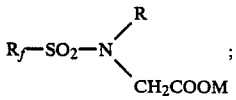

nonionic fluorine-containing surface active agents including perfluoroalkyl-containing polyhydric alcohols such as compound having the formula:

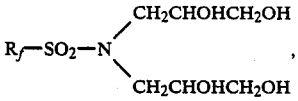

ethylene oxide addition product of perfluoroalcohol, oligomer containing perfluoroalkyl group and hydrophilic group, oligomer containing perfluoroalkyl group and lipophilic group, and urethane prepolymer containing perfluoroalkyl group and lipophilic group; cationic fluorine-containing surface active agents such as perfluoroalkyltrimethylammonium salt; amphoteric fluorine-containing surface active agents such as perfluoroalkylaminosulfonic acid salt. In the above formulae, $R_f$ is a perfluoroalkyl group preferably having 5 to 8 carbon atoms, R is an alkyl group preferably having 1 to 4 carbon atoms, and M is a metal ion. These surface active agents may be used singly or as admixtures thereof. Among these fluorine-containing surface active agents, those having relatively good heat-resistance and application property, such as perfluoroalkylsulfonic acid salt and perfluoroalkyl-containing polyhydric alcohol, are preferable. In particular, perfluoroalkylsulfonic acid salt wherein $R_f$ has 5 to 8 carbon atoms is preferable, because of its excellent heat-resistance.

Examples of the fluorine-containing polymer are tetrafluoroethylene-hexafluoropropylene copolymer, polychlorotrifluoroethylene, polyvinylidene fluoride and polytetrafluoroethylene.

Examples of the heat-resistant resin are thermoplastic or thermosetting resins having relatively high heat resistance, such as polyether sulfone, polyphenylene sulfide, polysulfone, epoxy resin, silicone resin, polyimide, phenolic resin, melamine resin and nitrocellulose. These resins may be used singly or as admixtures thereof.

The effects exhibited by the fluorine-containing compound, particularly the fluorine-containing surface active agent are as follows: The coating layer containing the fluorine-containing compound makes up the deficiency in heat resistance of the support and prevents the support from sticking to a thermal head heated up to a high temperature. The coating prevents the support from charging, so that a disadvantage that the thermal head, the transfer medium and the receiving paper are attracted to each other due to static electricity is eliminated. Further, the coating reduces the surface friction factor of the support, so that the slipping property between the support and the thermal head is improved.

The proportion of the fluorine-containing compound to the heat-resistant resin varies depending upon their kinds and is not particularly limited.

Usually the content of the fluorine-containing compound in the sticking-preventive layer is from 50 to 65% by weight. When the content is lower than 50% by weight, a sufficient slipping property is not obtained between the support and the thermal head, so that the sticking-preventive effect is not sufficiently improved. When the content is more than 65% by weight, the film-forming property of a coating composition becomes poor, and the resulting sticking-preventive layer rather causes sticking.

The heat-resistant resin used together with the fluorine-containing compound is used in order to impart application property as well as heat resistance of the fluorine-containing compound.

The content of the heat-resistant resin in the sticking-preventive layer is usually from 35 to 50% by weight. When the content is lower than 35% by weight, the film property and heat resistance of the sticking-preventive layer is not sufficiently improved, though the slipping property is improved. When the content is higher than 50% by weight, the slipping property is reduced, though the film property and heat-resistance are improved.

The sticking-preventive layer 7 is formed by applying a solution of the above components in an organic solvent or water to the back surface of the support by a usual coating method such as roller coating, gravure coating, reverse coating or spray coating and drying or curing the resulting coating.

The thickness of the sticking-preventive coating is preferably from 0.05 to 3 μm, more preferably from 0.1 to 1 μm. When the thickness is less than 0.05 μm, it is difficult to form a uniform coating. A coating having a thickness more than 3 μm is uneconomical, because it does not exhibit a better sticking-preventive effect than the coating having a thickness of 3 μm.

The present invention is more specifically described and explained by means of the following Examples. It is to be understood that the present invention is not limited to the Examples, and various change and modifications may be made in the invention without departing from the spirit and scope thereof.

EXAMPLE 1

A solution prepared by dissolving 20 parts (parts by weight, hereinafter the same) of an acrylic resin and 10 parts of a chlorinated rubber into a mixed solvent of 30 parts of toluene, 20 parts of methyl isobutyl ketone and 20 parts of cyclohexanone was applied onto a polyester film having a thickness of 3.5 μm and dried to give a protective resin layer having a thickness of 2 μm. Aluminum was deposited on the protective resin layer by a vacuum-deposition method to give an aluminum deposition layer having a thickness of 40 nm. A solution prepared by dissolving 10 parts of a polyamide resin and 10 parts of carnauba wax into a mixed solvent of 70 parts of toluene and 10 parts of isopropyl alcohol was applied onto the aluminum deposition layer and dried to give an adhesive layer having a thickness of 2 μm, thereby yielding a heat-sensitive transfer medium.

EXAMPLE 2

A solution prepared by dissolving 9 parts of paraffin wax and 1 part of ketone resin in a mixed solvent of 70 parts of toluene, 10 parts of terebine oil and 10 parts of petroleum naphtha was applied onto a polyester film having a thickness of 9 μm and dried to give a lubricant layer having a thickness of 0.1 μm. A solution prepared by dissolving 25 parts of styrene-maleic acid copolymer resin and 5 parts of an oil-soluble dye available under commercial name "Neozapon Yellow R", made by BASF in a mixed solvent of 30 parts of toluene, 20 parts of methyl isobutyl ketone and 20 parts of cyclohexanone was applied onto the lubricant layer and dried to give a yellow protective resin layer having a thickness of 2 μm. Aluminum was deposited onto the protective resin layer by a vacuum-deposition layer to give an aluminum deposition layer having a thickness of 40 nm. A solution prepared by dissolving 20 parts of paraffin wax and 10 parts of ethylene-vinyl acetate copolymer resin in a mixed solvent of 50 parts of toluene and 20 parts of terebine oil was applied onto the aluminum deposition layer and dried to give an adhesive layer having a thickness of 3 μm, thereby yielding a heat-sensitive transfer medium.

EXAMPLE 3

The same procedures as in Example 1 except that a solution prepared by dissolving or dispersing 20 parts of an acrylic resin, 10 parts of chlorinated rubber and 5 parts of a finely-divided silica (matting agent) into a mixed solvent of 25 parts of toluene, 20 parts of methyl isobutyl ketone and 20 parts of cyclohexanone was applied onto the polyester film and dried to give a matted protective resin layer having a thickness of 2 μm were repeated to give a heat-sensitive transfer medium.

EXAMPLE 4

The same procedures as in Example 2 except that a solution prepared by dissolving or dispersing 25 parts of styrene-maleic acid copolymer resin, 5 parts of Neozapon Yellow R and 5 parts of titanium oxide (matting agent) in a mixed solvent of 25 parts of toluene, 20 parts of methyl isobutyl ketone and 20 parts of cyclohexanone was applied onto the lubricant layer and dried to give a yellow matted protective resin layer having a thickness of 2 μm were repeated to give a heat-sensitive transfer medium.

Employing each of the heat-sensitive transfer media obtained in Examples 1 to 4, printing was carried out on a plain paper at a speed of 1,800 letters per minute by means of a thermal transfer printer available under commercial name "Canon CW-4253" made by Canon Inc.

The letter images formed on the plain paper by using the transfer media of Examples 1 and 2 assumed excellent metallic lusters close to specular gloss. The letter images formed on the plain paper by using the transfer media of Examples 3 and 4 assumed metallic luster matted suitably.

EXAMPLE 5

A solution prepared by dissolving 42 parts of perfluoroalkylsufonate wherein the perfluoroalkyl group had 8 carbon atoms ($C_8F_{17}$—$SO_3K$), available under commercial name "MEGAFAC F-110" made by DAI-NIPPON INK AND CHEMICALS, INC. and 40 parts of polysulfone in a mixed solvent of 760 parts of cyclohexanone, 118 parts of methyl ethyl ketone and 40 parts of methyl isobutyl ketone was applied onto one surface of a polyester film having a thickness of 3.5 μm and dried to give a sticking-preventive layer having a thickness of 0.5 μm.

A transfer layer was formed on the opposite surface of the polyester film in the same manner as in Example 1 to give a heat-sensitive transfer medium.

EXAMPLE 6

The same procedures as in Example 2 except that the same sticking-preventive layer as in Example 5 was formed on one surface of the polyester film were repeated to give a heat-sensitive transfer medium.

EXAMPLE 7

The same procedures as in Example 3 except that the same sticking-preventive layer as in Example 5 was formed on one surface of the polyester film were repeated to give a heat-sensitive transfer medium.

EXAMPLE 8

A solution prepared by dissolving 60 parts of perfluoroalkylsufonate (MEGAFAC F-110), 50 parts of silicone resin and 5 parts of a curing agent in 200 parts of xylene was applied onto one surface of a polyester film having a thickness of 9 μm and dried to give a sticking-preventive layer having a thickness of 0.5 μm.

A transfer layer was formed on the opposite surface of the polyester film in the same manner as in Example 4 to give a heat-sensitive transfer medium.

Employing each of the heat-sensitive transfer media obtained in Examples 5 to 8, printing was continuously carried out on 110 sheets of plain paper (A4 size) at a speed of 1,800 letters per minute by means of a thermal transfer printer (Canon CW-4253).

All the letter images formed on every sheet of the plain paper were clear with no defects such as getting out of shape and voids and of the same high density. During printing, there were observed no undesirable phenomena such as sticking of the thermal head to the support film and attaching of melts of the support film to the thermal head, i.e. formation of sticking-dust.

In addition to the ingredients used in the Examples, other ingredients can be used in the Examples as set forth in the specification to obtain substantially the same results.

What we claim is:

1. A method for producing print images having a metallic luster by use of a heat-sensitive transfer medium, which comprises the steps of:

(a) preparing a heat-sensitive transfer medium comprising a support and a transfer layer on one side of said support wherein said transfer layer comprises a protective resin layer having a heat deformation temperature of at least 120° C., a metal deposition layer on said resin layer, and an adhesive layer over said metal deposition layer;

(b) bringing said adhesive layer of said transfer layer into contact with a receiving medium; and (c) heating localized areas of said transfer layer by means of a thermal head which is brought into contact with the support of the transfer medium, thereby selectively transferring the heated areas of the transfer layer onto the receiving medium to form print images having a metallic luster on said receiving medium.

2. The method of claim 1, wherein the thickness of the protective resin layer, the thickness of the metal deposition layer and the thickness of the adhesive layer are from 0.5 to 2 μm, from 10 to 100 nm and from 1 to 10 μm, respectively.

3. The method of claim 2, wherein the support is a resin film having a thickness of 2.5 to 9 μm.

4. The method of claim 1, wherein the adhesive layer is melted at a temperature of 70° to 100° C.

5. The method of claim 1, wherein the protective resin layer is directly provided on the support.

6. The method of claim 1, wherein a lubricant layer is interposed between the support and the protective resin layer.

7. The method of claim 1, wherein the protective resin layer is a matted layer.

8. The method of claim 1, wherein a sticking-preventive layer is provided on the back surface of the support which is to be brought into contact with a thermal head.

9. The method of claim 8, wherein the sticking-preventive layer comprises a fluorine-containing compound as a main component and a heat-resistant resin.

10. The method of claim 9, wherein the fluorine-containing compound is a fluorine-containing surface active agent.

11. The method of claim 10, wherein the fluorine-containing surface active agent is perfluoroalkylsulfonic acid salt.

12. The method of claim 11, wherein the perfluoroalkylsulfonic acid salt is one wherein the perfluoroalkyl group has 5 to 8 carbon atoms.

13. The method of claim 8, wherein the thickness of the sticking-preventive layer is from 0.05 to 3 μm.

* * * * *